US010154707B2

(12) United States Patent
Prest et al.

(10) Patent No.: US 10,154,707 B2
(45) Date of Patent: Dec. 18, 2018

(54) FASTENERS OF BULK AMORPHOUS ALLOY

(75) Inventors: Christopher D. Prest, San Francisco, CA (US); Joseph C. Poole, San Francisco, CA (US); Theodore A. Waniuk, Lake Forest, CA (US); Quoc Tran Pham, Anaheim, CA (US); Joseph Stevick, Olympia, WA (US)

(73) Assignee: APPLE INC., Cupertino, CA (US)

( * ) Notice: Subject to any disclaimer, the term of this patent is extended or adjusted under 35 U.S.C. 154(b) by 895 days.

(21) Appl. No.: 14/387,046

(22) PCT Filed: Mar. 23, 2012

(86) PCT No.: PCT/US2012/030372

§ 371 (c)(1),
(2), (4) Date: Jun. 19, 2015

(87) PCT Pub. No.: WO2013/141878

PCT Pub. Date: Sep. 26, 2013

(65) Prior Publication Data

US 2015/0289605 A1 Oct. 15, 2015

(51) Int. Cl.

| | |
|---|---|
| ***C22C 45/10*** | (2006.01) |
| ***A44B 13/00*** | (2006.01) |
| ***A44B 18/00*** | (2006.01) |
| ***C22C 1/00*** | (2006.01) |
| ***C22C 33/00*** | (2006.01) |

(Continued)

(52) U.S. Cl.

CPC ..... *A44B 18/0069* (2013.01); *A44B 13/0017* (2013.01); *A44B 18/00* (2013.01); *A44B 18/0057* (2013.01); *A44B 18/0061* (2013.01); *B21F 1/00* (2013.01); *B21F 15/00* (2013.01); *B21F 45/16* (2013.01); *B22D 25/02* (2013.01); *B22D 25/06* (2013.01); *C22C 1/002* (2013.01); *C22C 33/003* (2013.01); *C22C 45/00* (2013.01); *C22C 45/001* (2013.01);

(Continued)

(58) Field of Classification Search

None

See application file for complete search history.

(56) References Cited

U.S. PATENT DOCUMENTS 2,590,558 A * 3/1952 Mickelson ..... A01K 85/16 43/42

3,461,513 A 8/1969 Girard et al.

(Continued)

FOREIGN PATENT DOCUMENTS

| | | |
|---|---|---|
| CN | 1270554 | 10/2000 |
| DE | 102004048464 | 4/2006 |

(Continued)

OTHER PUBLICATIONS

International Search Report and Written Opinion, dated Nov. 29, 2012, PCT/ISA/210, PCT/ISA/220, PCT/ISA/237.

(Continued)

*Primary Examiner* — George Wyszomierski

(74) *Attorney, Agent, or Firm* — Dorsey & Whitney LLP

(57) ABSTRACT

Embodiments relates to a hook side fastener having hooks and a loop side fastener having loops. The hooks and/or loops are made of bulk solidifying amorphous metal alloy. Other embodiments relate to methods of making and using the hook side and loop side fasteners.

21 Claims, 6 Drawing Sheets

(51) Int. Cl.

| | |
|---|---|
| ***C22C 45/00*** | (2006.01) |
| ***C22C 45/02*** | (2006.01) |
| ***B21F 1/00*** | (2006.01) |
| ***B21F 15/00*** | (2006.01) |
| ***B21F 45/16*** | (2006.01) |
| ***B22D 25/02*** | (2006.01) |
| ***B22D 25/06*** | (2006.01) |

(52) U.S. Cl.
CPC ..... *C22C 45/003* (2013.01); *C22C 45/02* (2013.01); *C22C 45/10* (2013.01)

(56) References Cited

U.S. PATENT DOCUMENTS

| | | | | |
|---|---|---|---|---|
| 3,600,838 | A * | 8/1971 | Bablick | A01K 83/06 43/43.6 |
| 5,288,344 | A | 2/1994 | Peker et al. | |
| 5,368,659 | A | 11/1994 | Peker et al. | |
| 5,618,359 | A | 4/1997 | Lin et al. | |
| 5,735,975 | A | 4/1998 | Lin et al. | |
| 6,325,868 | B1 | 12/2001 | Kim et al. | |
| 6,818,078 | B2 | 11/2004 | Kim et al. | |
| 7,575,040 | B2 | 8/2009 | Johnson et al. | |
| 7,618,499 | B2 | 11/2009 | Johnson et al. | |
| 7,806,997 | B2 | 10/2010 | Demetriou et al. | |
| 7,947,134 | B2 | 5/2011 | Lohwongwatana et al. | |
| 8,480,864 | B2 | 7/2013 | Farmer et al. | |
| 8,529,712 | B2 | 9/2013 | Demetriou et al. | |
| 8,961,091 | B2 * | 2/2015 | Prest | B21J 1/006 411/424 |
| 9,823,624 | B2 * | 11/2017 | Tsuchiya | G04D 3/0076 |
| 2004/0074062 | A1 | 4/2004 | Stanford | |
| 2004/0267349 | A1 * | 12/2004 | Richter | A61L 17/145 623/1.13 |
| 2006/0216461 | A1 | 9/2006 | Tachauer | |
| 2008/0125848 | A1 * | 5/2008 | Kusleika | A61L 29/02 623/1.11 |
| 2008/0209794 | A1 * | 9/2008 | Anderson | A01K 83/00 43/43.16 |

FOREIGN PATENT DOCUMENTS

| | | |
|---|---|---|
| JP | 2001303218 | 10/2001 |
| JP | 2011169458 | 9/2011 |
| WO | WO 95/035181 | 12/1995 |
| WO | 2006/047552 | 5/2006 |

OTHER PUBLICATIONS

Inoue et al., "Bulk amorphous alloys with high mechanical strength and good soft magnetic properties in Fe-TM-B (TM=IV-VIII group transition metal) system," *Appl. Phys. Lett*, 1997, vol. 71, No. 4, pp. 464-466.

Shen et al., "Bulk Glassy $Co_{43}FE_{20}TA_{5.5}B_{31.5}$ Alloy with High Glass-Forming Ability and Good Soft Magnetic Properties," *Materials Transactions*, 2001 The Japan Institute of Metals, vol. 42, No. 10 p. 2136-2139.

* cited by examiner

FIGURE 3A
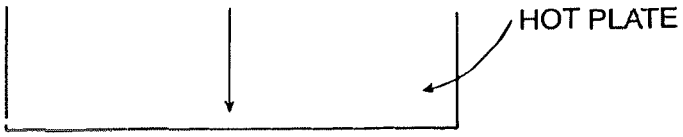
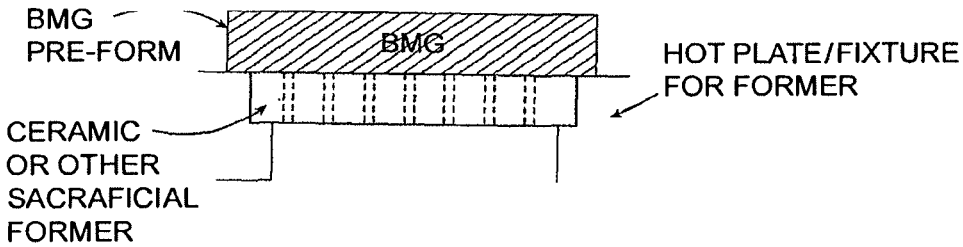
FIGURE 3B
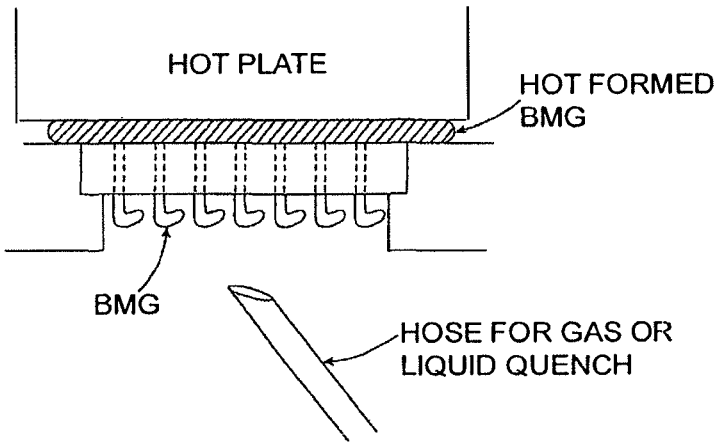

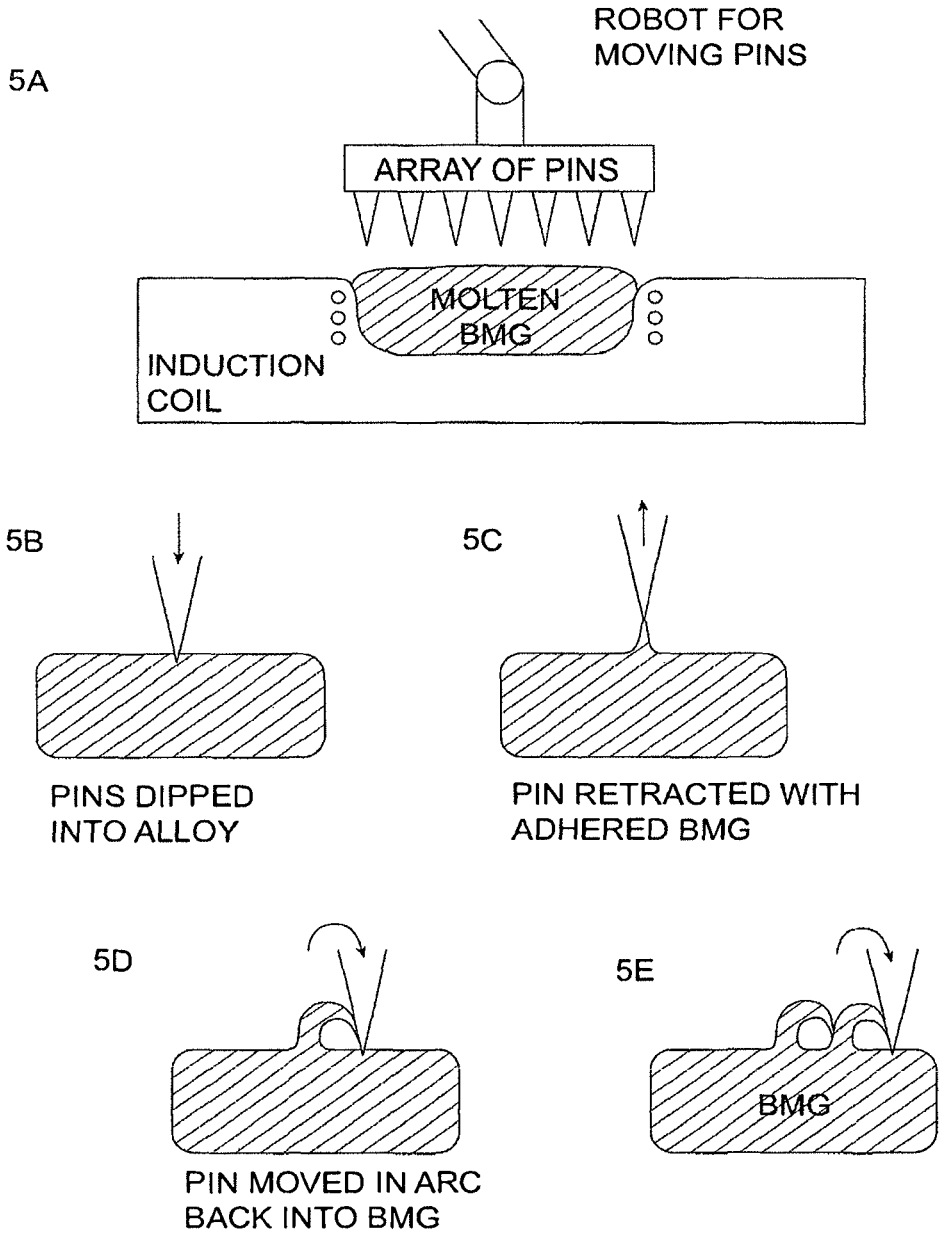
5A
ROBOT FOR MOVING PINS
ARRAY OF PINS
MOLTEN BMG
INDUCTION COIL
5B
PINS DIPPED INTO ALLOY
5C
PIN RETRACTED WITH ADHERED BMG
5D
PIN MOVED IN ARC BACK INTO BMG
5E
BMG

FASTENERS OF BULK AMORPHOUS ALLOY

FIELD OF THE INVENTION

The present invention relates to fasteners, particularly permanent or semi-permanent locking fasteners, wherein at least portion is made of bulk-solidifying amorphous metal alloy.

BACKGROUND

One of the most well-known semi-permanent fasteners is a hook-and-loop fastener having the brand name of Velcro. Hook-and-loop fasteners consist of two components: typically, two lineal fabric strips (or, alternatively, round dots or squares) which are attached (e.g., sewn, adhered, etc.) to the opposing surfaces to be fastened. The first component features tiny hooks; the second features even smaller and "hairier" loops. When the two faces are pressed together, the hooks catch in the loops and the two pieces fasten or bind temporarily. When separated, by pulling or peeling the two surfaces apart, the Velcro strips make a distinctive ripping sound. The first Velcro sample was made of cotton, which proved impractical and was replaced by Nylon and polyester. Velcro fasteners made of Teflon loops, polyester hooks, and glass backing are used in aerospace applications, e.g. on space shuttles.

Permanently locking fasteners are generally known and made of conventional metals, such as aluminum, brass, copper and steel, e.g., case hardened steel and stainless steel. These conventional metals and alloys deform via the formation of dislocations, i.e., plastic work. For these conventional metals, the fabrication processes can mostly be placed into two categories—forming and cutting. Forming processes are those in which the applied force causes the material to plastically deform, but not to fail. Such processes are able to bend or stretch the metal into a desired shape. Cutting processes are those in which the applied force causes the material to fail and separate, allowing the material to be cut or removed. While the currently available fasteners are effective, an ever continuing need exists for permanent or semi-permanent fasteners, particularly tamper-resistant fasteners for electronic devices.

Tampering involves the deliberate altering or breaking open a product, package, or system. Tamper-resistance is resistance to tampering by either the normal users of a product, package, or system or others with physical access to it. There are many reasons for employing tamper-resistance. Tamper-resistance ranges from simple features like screws with special heads, more complex devices that render themselves inoperable or encrypt all data transmissions between individual chips, or use of materials needing special tools and knowledge. Tamper-resistant devices or features are common on packages to deter package or product tampering. In some applications, devices are only tamper-evident rather than tamper-resistant.

It has been argued that it is very difficult to make simple fasteners, particularly for electronic devices, to secure against tampering, because numerous types of attacks are possible. Yet, there is a need for a simple, but effective, permanent or semi-permanent fastener that would at least obviate physical tampering or make the fastener, and possibly the device to which the fastener is attached, non-functional if the fastener has been tampered with.

SUMMARY

A proposed solution according to embodiments herein relate to permanent and semi-permanent fastening by bonding together a hook side fastener having hoops and a loop side fastener having loops. The hooks and/or loops are made bulk solidifying amorphous alloy. A method of fastening could include obtaining the hook side fastener, obtaining the loop side fastener, and bonding the hooks and loops together to form a permanent or semi-permanent bond.

BRIEF DESCRIPTION OF THE DRAWINGS

FIGS. 3A and 3B provide schematic diagrams of a method to manufacture a hook side fastener of the embodiments herein.

FIGS. 5A to 5E provide schematic diagrams of a method to manufacture a loop side fastener of the embodiments herein.

DETAILED DESCRIPTION

All publications, patents, and patent applications cited in this Specification are hereby incorporated by reference in their entirety.

The articles "a" and "an" are used herein to refer to one or to more than one (i.e., to at least one) of the grammatical object of the article. By way of example, "a polymer resin" means one polymer resin or more than one polymer resin. Any ranges cited herein are inclusive. The terms "substantially" and "about" used throughout this Specification are used to describe and account for small fluctuations. For example, they can refer to less than or equal to ±5%, such as less than or equal to ±2%, such as less than or equal to ±1%, such as less than or equal to ±0.5%, such as less than or equal to ±0.2%, such as less than or equal to ±0.1%, such as less than or equal to ±0.05%.

Bulk-solidifying amorphous alloys, or bulk metallic glasses ("BMG"), are a recently developed class of metallic materials. These alloys may be solidified and cooled at relatively slow rates, and they retain the amorphous, non-crystalline (i.e., glassy) state at room temperature. Amorphous alloys have many superior properties than their crystalline counterparts. However, if the cooling rate is not sufficiently high, crystals may form inside the alloy during cooling, so that the benefits of the amorphous state can be lost. For example, one challenge with the fabrication of bulk amorphous alloy parts is partial crystallization of the parts due to either slow cooling or impurities in the raw alloy material. As a high degree of amorphicity (and, conversely, a low degree of crystallinity) is desirable in BMG parts, there is a need to develop methods for casting BMG parts having controlled amount of amorphicity.

Figure 1:
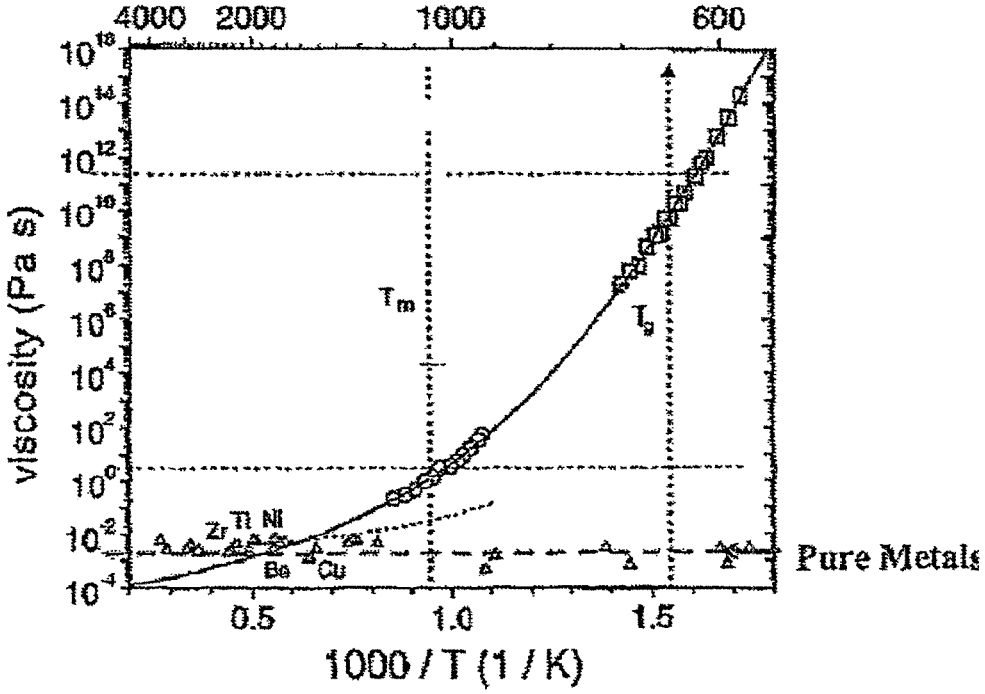
FIG. 1 provides a temperature-viscosity diagram of an exemplary bulk solidifying amorphous alloy.

FIG. 1 (obtained from U.S. Pat. No. 7,575,040) shows a viscosity-temperature graph of an exemplary bulk solidifying amorphous alloy, from the VIT-001 series of Zr—Ti—Ni—Cu—Be family manufactured by Liquidmetal Technology. It should be noted that there is no clear liquid/solid transformation for a bulk solidifying amorphous metal during the formation of an amorphous solid. The molten alloy becomes more and more viscous with increasing undercooling until it approaches solid form around the glass transition temperature. Accordingly, the temperature of solidification front for bulk solidifying amorphous alloys can be around glass transition temperature, where the alloy will practically act as a solid for the purposes of pulling out the quenched amorphous sheet product.

Figure 2:
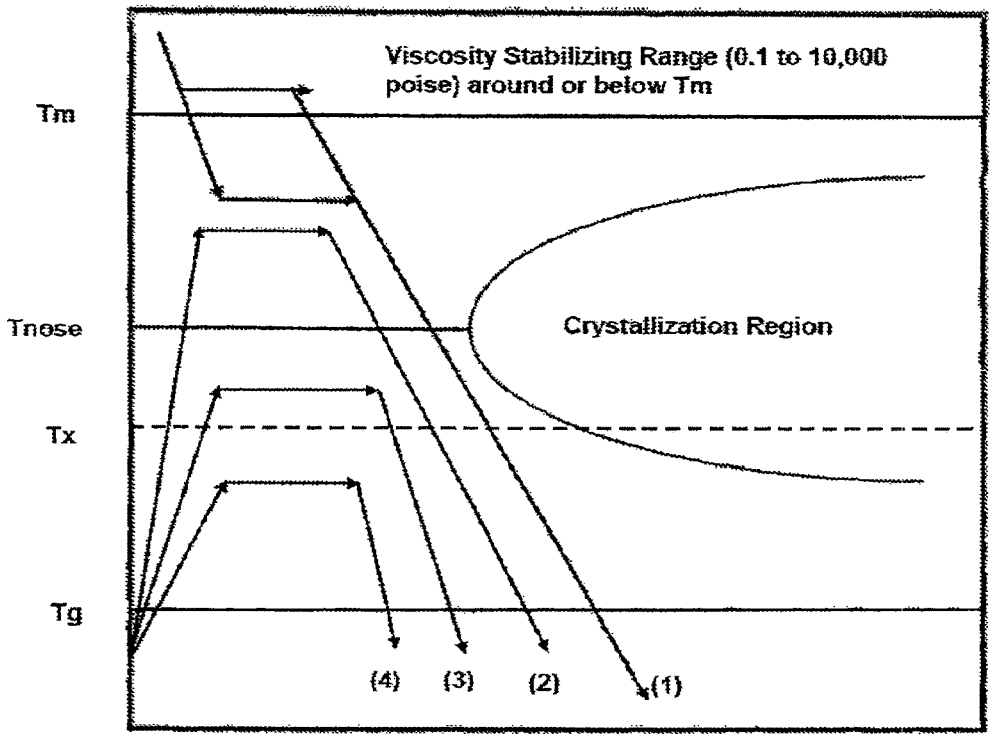
FIG. 2 provides a schematic of a time-temperature-transformation (TTT) diagram for an exemplary bulk solidifying amorphous alloy.

FIG. 2 (obtained from U.S. Pat. No. 7,575,040) shows the time-temperature-transformation (TTT) cooling curve of an exemplary bulk solidifying amorphous alloy, or TTT diagram. Bulk-solidifying amorphous metals do not experience a liquid/solid crystallization transformation upon cooling, as with conventional metals. Instead, the highly fluid, non crystalline form of the metal found at high temperatures (near a "melting temperature" Tm) becomes more viscous as the temperature is reduced (near to the glass transition temperature Tg), eventually taking on the outward physical properties of a conventional solid.

Even though there is no liquid/crystallization transformation for a bulk solidifying amorphous metal, a "melting temperature" Tm may be defined as the thermodynamic liquidus temperature of the corresponding crystalline phase. Under this regime, the viscosity of bulk-solidifying amorphous alloys at the melting temperature could lie in the range of about 0.1 poise to about 10,000 poise, and even sometimes under 0.01 poise. A lower viscosity at the "melting temperature" could provide faster and complete filling of intricate portions of the shell/mold with a bulk solidifying amorphous metal for forming the BMG parts. Furthermore, the cooling rate of the molten metal to form a BMG part has to such that the time-temperature profile during cooling does not traverse through the nose-shaped region bounding the crystallized region in the TTT diagram of FIG. 2. In FIG. 2, Tnose is the critical crystallization temperature Tx where crystallization is most rapid and occurs in the shortest time scale.

The supercooled liquid region, the temperature region between Tg and Tx is a manifestation of the extraordinary stability against crystallization of bulk solidification alloys. In this temperature region the bulk solidifying alloy can exist as a high viscous liquid. The viscosity of the bulk solidifying alloy in the supercooled liquid region can vary between $10^{12}$ Pa s at the glass transition temperature down to $10^{5}$ Pa s at the crystallization temperature, the high temperature limit of the supercooled liquid region. Liquids with such viscosities can undergo substantial plastic strain under an applied pressure. The embodiments herein make use of the large plastic formability in the supercooled liquid region as a forming and separating method.

One needs to clarify something about Tx. Technically, the nose-shaped curve shown in the TTT diagram describes Tx as a function of temperature and time. Thus, regardless of the trajectory that one takes while heating or cooling a metal alloy, when one hits the TTT curve, one has reached Tx. In FIG. 2, Tx is shown as a dashed line as Tx can vary from close to Tm to close to Tg.

The schematic TTT diagram of FIG. 2 shows processing methods of die casting from at or above Tm to below Tg without the time-temperature trajectory (shown as (1) as an example trajectory) hitting the TTT curve. During die casting, the forming takes place substeantially simultaneously with fast cooling to avoid the trajectory hitting the TTT curve. The procssing methods for superplastic forming (SPF), also referred to as thermoplastic forming, from at or below Tg to below Tm without the time-temperature trajectory (shown as (2), (3) and (4) as example trajectories) hitting the TTT curve. In SPF, the amorphous BMG is reheated into the supercooled liquid region where the available processing window could be much larger than die casting, resulting in better controllability of the process. The SPF process does not require fast cooling to avoid crystallization during cooling. Also, as shown by example trajectories (2), (3) and (4), the SPF can be carried out with the highest temperature during SPF being above Tnose or below Tnose, up to about Tm. If one heats up a piece of amorphous alloy but manages to avoid hitting the TTT curve, you have heated "between Tg and Tm", but one could have not reached Tx.

Typical differential scanning calorimeter (DSC) heating curves of bulk-solidifying amorphous alloys taken at a heating rate of 20 degree C./min describe, for the most part, a particular trajectory across the TTT data where one could likely see a Tg at a certain temperature, a Tx when the DSC heating ramp crosses the TTT crystallization onset, and eventually melting peaks when the same trajectory crosses the temperature range for melting. If one heats a bulk-solidifying amorphous alloy at a rapid heating rate as shown by the ramp up portion of trajectories (2), (3) and (4) in FIG. 2, then one could avoid the TTT curve entirely, and the DSC data could show a glass transition but no Tx upon heating. Another way to think about it is trajectories (2), (3) and (4) can fall anywhere in temperature between the nose of the TTT curve (and even above it) and the Tg line, as long as it does not hit the crystallization curve. That just means that the horizontal plateau in trajectories might get much shorter as one increases the processing temperature.

Phase

The term "phase" herein can refer to one that can be found in a thermodynamic phase diagram. A phase is a region of space (e.g., a thermodynamic system) throughout which all physical properties of a material are essentially uniform. Examples of physical properties include density, index of refraction, chemical composition and lattice periodicity. A simple description of a phase is a region of material that is chemically uniform, physically distinct, and/or mechanically separable. For example, in a system consisting of ice and water in a glass jar, the ice cubes are one phase, the water is a second phase, and the humid air over the water is a third phase. The glass of the jar is another separate phase. A phase can refer to a solid solution, which can be a binary, tertiary, quaternary, or more, solution, or a compound, such as an intermetallic compound. As another example, an amorphous phase is distinct from a crystalline phase.

Metal, Transition Metal, and Non-Metal

The term "metal" refers to an electropositive chemical element. The term "element" in this Specification refers generally to an element that can be found in a Periodic Table. Physically, a metal atom in the ground state contains a partially filled band with an empty state close to an occupied state. The term "transition metal" is any of the metallic elements within Groups 3 to 12 in the Periodic Table that have an incomplete inner electron shell and that serve as transitional links between the most and the least electropositive in a series of elements. Transition metals are characterized by multiple valences, colored compounds, and the ability to form stable complex ions. The term "nonmetal" refers to a chemical element that does not have the capacity to lose electrons and form a positive ion.

Depending on the application, any suitable nonmetal elements, or their combinations, can be used. The alloy (or "alloy composition") can comprise multiple nonmetal elements, such as at least two, at least three, at least four, or more, nonmetal elements. A nonmetal element can be any element that is found in Groups 13-17 in the Periodic Table. For example, a nonmetal element can be any one of F, Cl, Br, I, At, O, S, Se, Te, Po, N, P, As, Sb, Bi, C, Si, Ge, Sn, Pb, and B. Occasionally, a nonmetal element can also refer to certain metalloids (e.g., B, Si, Ge, As, Sb, Te, and Po) in Groups 13-17. In one embodiment, the nonmetal elements can include B, Si, C, P, or combinations thereof. Accordingly, for example, the alloy can comprise a boride, a carbide, or both.

A transition metal element can be any of scandium, titanium, vanadium, chromium, manganese, iron, cobalt, nickel, copper, zinc, yttrium, zirconium, niobium, molybdenum, technetium, ruthenium, rhodium, palladium, silver, cadmium, hafnium, tantalum, tungsten, rhenium, osmium, iridium, platinum, gold, mercury, rutherfordium, dubnium, seaborgium, bohrium, has sium, meitnerium, ununnilium, unununium, and ununbium. In one embodiment, a BMG containing a transition metal element can have at least one of Sc, Y, La, Ac, Ti, Zr, Hf, V, Nb, Ta, Cr, Mo, W, Mn, Tc, Re, Fe, Ru, Os, Co, Rh, Ir, Ni, Pd, Pt, Cu, Ag, Au, Zn, Cd, and Hg. Depending on the application, any suitable transitional metal elements, or their combinations, can be used. The alloy composition can comprise multiple transitional metal elements, such as at least two, at least three, at least four, or more, transitional metal elements.

The presently described alloy or alloy "sample" or "specimen" alloy can have any shape or size. For example, the alloy can have a shape of a particulate, which can have a shape such as spherical, ellipsoid, wire-like, rod-like, sheet-like, flake-like, or an irregular shape. The particulate can have any size. For example, it can have an average diameter of between about 1 micron and about 100 microns, such as between about 5 microns and about 80 microns, such as between about 10 microns and about 60 microns, such as between about 15 microns and about 50 microns, such as between about 15 microns and about 45 microns, such as between about 20 microns and about 40 microns, such as between about 25 microns and about 35 microns. For example, in one embodiment, the average diameter of the particulate is between about 25 microns and about 44 microns. In some embodiments, smaller particulates, such as those in the nanometer range, or larger particulates, such as those bigger than 100 microns, can be used.

The alloy sample or specimen can also be of a much larger dimension. For example, it can be a bulk structural component, such as an ingot, housing/casing of an electronic device or even a portion of a structural component that has dimensions in the millimeter, centimeter, or meter range.

Solid Solution

The term "solid solution" refers to a solid form of a solution. The term "solution" refers to a mixture of two or more substances, which may be solids, liquids, gases, or a combination of these. The mixture can be homogeneous or heterogeneous. The term "mixture" is a composition of two or more substances that are combined with each other and are generally capable of being separated. Generally, the two or more substances are not chemically combined with each other.

Alloy

In some embodiments, the alloy composition described herein can be fully alloyed. In one embodiment, an "alloy" refers to a homogeneous mixture or solid solution of two or more metals, the atoms of one replacing or occupying interstitial positions between the atoms of the other; for example, brass is an alloy of zinc and copper. An alloy, in contrast to a composite, can refer to a partial or complete solid solution of one or more elements in a metal matrix, such as one or more compounds in a metallic matrix. The term alloy herein can refer to both a complete solid solution alloy that can give single solid phase microstructure and a partial solution that can give two or more phases. An alloy composition described herein can refer to one comprising an alloy or one comprising an alloy-containing composite.

Thus, a fully alloyed alloy can have a homogenous distribution of the constituents, be it a solid solution phase, a compound phase, or both. The term "fully alloyed" used herein can account for minor variations within the error tolerance. For example, it can refer to at least 90% alloyed, such as at least 95% alloyed, such as at least 99% alloyed, such as at least 99.5% alloyed, such as at least 99.9% alloyed. The percentage herein can refer to either volume percent or weight percentage, depending on the context. These percentages can be balanced by impurities, which can be in terms of composition or phases that are not a part of the alloy.

Amorphous or Non-Crystalline Solid

An "amorphous" or "non-crystalline solid" is a solid that lacks lattice periodicity, which is characteristic of a crystal. As used herein, an "amorphous solid" includes "glass" which is an amorphous solid that softens and transforms into a liquid-like state upon heating through the glass transition. Generally, amorphous materials lack the long-range order characteristic of a crystal, though they can possess some short-range order at the atomic length scale due to the nature of chemical bonding. The distinction between amorphous solids and crystalline solids can be made based on lattice periodicity as determined by structural characterization techniques such as x-ray diffraction and transmission electron microscopy.

The terms "order" and "disorder" designate the presence or absence of some symmetry or correlation in a many-particle system. The terms "long-range order" and "short-range order" distinguish order in materials based on length scales.

The strictest form of order in a solid is lattice periodicity: a certain pattern (the arrangement of atoms in a unit cell) is repeated again and again to form a translationally invariant tiling of space. This is the defining property of a crystal. Possible symmetries have been classified in 14 Bravais lattices and 230 space groups.

Lattice periodicity implies long-range order. If only one unit cell is known, then by virtue of the translational symmetry it is possible to accurately predict all atomic positions at arbitrary distances. The converse is generally true, except, for example, in quasi-crystals that have perfectly deterministic tilings but do not possess lattice periodicity.

Long-range order characterizes physical systems in which remote portions of the same sample exhibit correlated behavior. This can be expressed as a correlation function, namely the spin-spin correlation function: $G(x,x')=\langle s(x),s(x')\rangle$.

In the above function, s is the spin quantum number and x is the distance function within the particular system. This function is equal to unity when $x=x'$ and decreases as the distance $|x-x'|$ increases. Typically, it decays exponentially to zero at large distances, and the system is considered to be disordered. If, however, the correlation function decays to a constant value at large $|x-x'|$, then the system can be said to possess long-range order. If it decays to zero as a power of the distance, then it can be called quasi-long-range order. Note that what constitutes a large value of $|x-x'|$ is relative.

A system can be said to present quenched disorder when some parameters defining its behavior are random variables that do not evolve with time (i.e., they are quenched or frozen)—e.g., spin glasses. It is opposite to annealed disorder, where the random variables are allowed to evolve themselves. Embodiments herein include systems comprising quenched disorder.

The alloy described herein can be crystalline, partially crystalline, amorphous, or substantially amorphous. For example, the alloy sample/specimen can include at least some crystallinity, with grains/crystals having sizes in the nanometer and/or micrometer ranges. Alternatively, the alloy can be substantially amorphous, such as fully amorphous. In one embodiment, the alloy composition is at least substantially not amorphous, such as being substantially crystalline, such as being entirely crystalline.

In one embodiment, the presence of a crystal or a plurality of crystals in an otherwise amorphous alloy can be construed as a "crystalline phase" therein. The degree of crystallinity (or "crystallinity" for short in some embodiments) of an alloy can refer to the amount of the crystalline phase present in the alloy. The degree can refer to, for example, a fraction of crystals present in the alloy. The fraction can refer to volume fraction or weight fraction, depending on the context. A measure of how "amorphous" an amorphous alloy is can be amorphicity. Amorphicity can be measured in terms of a degree of crystallinity. For example, in one embodiment, an alloy having a low degree of crystallinity can be said to have a high degree of amorphicity. In one embodiment, for example, an alloy having 60 vol % crystalline phase can have a 40 vol % amorphous phase.

Amorphous Alloy or Amorphous Metal

An "amorphous alloy" is an alloy having an amorphous content of more than 50% by volume, preferably more than 90% by volume of amorphous content, more preferably more than 95% by volume of amorphous content, and most preferably more than 99% to almost 100% by volume of amorphous content. Note that, as described above, an alloy high in amorphicity is equivalently low in degree of crystallinity. An "amorphous metal" is an amorphous metal material with a disordered atomic-scale structure. In contrast to most metals, which are crystalline and therefore have a highly ordered arrangement of atoms, amorphous alloys are non-crystalline. Materials in which such a disordered structure is produced directly from the liquid state during cooling are sometimes referred to as "glasses." Accordingly, amorphous metals are commonly referred to as "metallic glasses" or "glassy metals." In one embodiment, a bulk metallic glass ("BMG") can refer to an alloy, of which the microstructure is at least partially amorphous. However, there are several ways besides extremely rapid cooling to produce amorphous metals, including physical vapor deposition, solid-state reaction, ion irradiation, melt spinning, and mechanical alloying. Amorphous alloys can be a single class of materials, regardless of how they are prepared.

Amorphous metals can be produced through a variety of quick-cooling methods. For instance, amorphous metals can be produced by sputtering molten metal onto a spinning metal disk. The rapid cooling, on the order of millions of degrees a second, can be too fast for crystals to form, and the material is thus "locked in" a glassy state. Also, amorphous metals/alloys can be produced with critical cooling rates low enough to allow formation of amorphous structures in thick layers—e.g., bulk metallic glasses.

The terms "bulk metallic glass" ("BMG"), bulk amorphous alloy ("BAA"), and bulk solidifying amorphous alloy are used interchangeably herein. They refer to amorphous alloys having the smallest dimension at least in the millimeter range. For example, the dimension can be at least about 0.5 mm, such as at least about 1 mm, such as at least about 2 mm, such as at least about 4 mm, such as at least about 5 mm, such as at least about 6 mm, such as at least about 8 mm, such as at least about 10 mm, such as at least about 12 mm. Depending on the geometry, the dimension can refer to the diameter, radius, thickness, width, length, etc. A BMG can also be a metallic glass having at least one dimension in the centimeter range, such as at least about 1.0 cm, such as at least about 2.0 cm, such as at least about 5.0 cm, such as at least about 10.0 cm. In some embodiments, a BMG can have at least one dimension at least in the meter range. A BMG can take any of the shapes or forms described above, as related to a metallic glass. Accordingly, a BMG described herein in some embodiments can be different from a thin film made by a conventional deposition technique in one important aspect—the former can be of a much larger dimension than the latter.

Amorphous metals can be an alloy rather than a pure metal. The alloys may contain atoms of significantly different sizes, leading to low free volume (and therefore having viscosity up to orders of magnitude higher than other metals and alloys) in a molten state. The viscosity prevents the atoms from moving enough to form an ordered lattice. The material structure may result in low shrinkage during cooling and resistance to plastic deformation. The absence of grain boundaries, the weak spots of crystalline materials in some cases, may, for example, lead to better resistance to wear and corrosion. In one embodiment, amorphous metals, while technically glasses, may also be much tougher and less brittle than oxide glasses and ceramics.

Thermal conductivity of amorphous materials may be lower than that of their crystalline counterparts. To achieve formation of an amorphous structure even during slower cooling, the alloy may be made of three or more components, leading to complex crystal units with higher potential energy and lower probability of formation. The formation of amorphous alloy can depend on several factors: the composition of the components of the alloy; the atomic radius of the components (preferably with a significant difference of over 12% to achieve high packing density and low free volume); and the negative heat of mixing the combination of components, inhibiting crystal nucleation and prolonging the time the molten metal stays in a supercooled state. However, as the formation of an amorphous alloy is based on many different variables, it can be difficult to make a prior determination of whether an alloy composition could form an amorphous alloy.

Amorphous alloys, for example, of boron, silicon, phosphorus, and other glass formers with magnetic metals (iron, cobalt, nickel) may be magnetic, with low coercivity and high electrical resistance. The high resistance leads to low losses by eddy currents when subjected to alternating magnetic fields, a property useful, for example, as transformer magnetic cores.

Amorphous alloys may have a variety of potentially useful properties. In particular, they tend to be stronger than crystalline alloys of similar chemical composition, and they can sustain larger reversible ("elastic") deformations than crystalline alloys. Amorphous metals derive their strength directly from their non-crystalline structure, which can have none of the defects (such as dislocations) that limit the strength of crystalline alloys. For example, one modern amorphous metal, known as Vitreloy™, has a tensile strength that is almost twice that of high-grade titanium. In some embodiments, metallic glasses at room temperature are not ductile and tend to fail suddenly when loaded in tension, which limits the material applicability in reliability-critical applications, as the impending failure is not evident. Therefore, to overcome this challenge, metal matrix composite materials having a metallic glass matrix containing dendritic particles or fibers of a ductile crystalline metal can be used. Alternatively, a BMG low in element(s) that tend to cause embitterment (e.g., Ni) can be used. For example, a Ni-free BMG can be used to improve the ductility of the BMG.

Another useful property of bulk amorphous alloys is that they can be true glasses; in other words, they can soften and flow upon heating. This can allow for easy processing, such as by injection molding, in much the same way as polymers. As a result, amorphous alloys can be used for making sports equipment, medical devices, electronic components and equipment, and thin films. Thin films of amorphous metals can be deposited as protective coatings via a high velocity oxygen fuel technique.

A material can have an amorphous phase, a crystalline phase, or both. The amorphous and crystalline phases can have the same chemical composition and differ only in the microstructure—i.e., one amorphous and the other crystalline. Microstructure in one embodiment refers to the structure of a material as revealed by a microscope at 25× magnification or higher. Alternatively, the two phases can have different chemical compositions and microstructures. For example, a composition can be partially amorphous, substantially amorphous, or completely amorphous.

As described above, the degree of amorphicity (and conversely the degree of crystallinity) can be measured by fraction of crystals present in the alloy. The degree can refer to volume fraction of weight fraction of the crystalline phase present in the alloy. A partially amorphous composition can refer to a composition of at least about 5 vol % of which is of an amorphous phase, such as at least about 10 vol %, such as at least about 20 vol %, such as at least about 40 vol %, such as at least about 60 vol %, such as at least about 80 vol %, such as at least about 90 vol %. The terms "substantially" and "about" have been defined elsewhere in this application. Accordingly, a composition that is at least substantially amorphous can refer to one of which at least about 90 vol % is amorphous, such as at least about 95 vol %, such as at least about 98 vol %, such as at least about 99 vol %, such as at least about 99.5 vol %, such as at least about 99.8 vol %, such as at least about 99.9 vol %. In one embodiment, a substantially amorphous composition can have some incidental, insignificant amount of crystalline phase present therein.

In one embodiment, an amorphous alloy composition can be homogeneous with respect to the amorphous phase. A substance that is uniform in composition is homogeneous. This is in contrast to a substance that is heterogeneous. The term "composition" refers to the chemical composition and/or microstructure in the substance. A substance is homogeneous when a volume of the substance is divided in half and both halves have substantially the same composition. For example, a particulate suspension is homogeneous when a volume of the particulate suspension is divided in half and both halves have substantially the same volume of particles. However, it might be possible to see the individual particles under a microscope. Another example of a homogeneous substance is air where different ingredients therein are equally suspended, though the particles, gases and liquids in air can be analyzed separately or separated from air.

A composition that is homogeneous with respect to an amorphous alloy can refer to one having an amorphous phase substantially uniformly distributed throughout its microstructure. In other words, the composition macroscopically comprises a substantially uniformly distributed amorphous alloy throughout the composition. In an alternative embodiment, the composition can be of a composite, having an amorphous phase having therein a non-amorphous phase. The non-amorphous phase can be a crystal or a plurality of crystals. The crystals can be in the form of particulates of any shape, such as spherical, ellipsoid, wire-like, rod-like, sheet-like, flake-like, or an irregular shape. In one embodiment, it can have a dendritic form. For example, an at least partially amorphous composite composition can have a crystalline phase in the shape of dendrites dispersed in an amorphous phase matrix; the dispersion can be uniform or non-uniform, and the amorphous phase and the crystalline phase can have the same or a different chemical composition. In one embodiment, they have substantially the same chemical composition. In another embodiment, the crystalline phase can be more ductile than the BMG phase.

The methods described herein can be applicable to any type of amorphous alloy. Similarly, the amorphous alloy described herein as a constituent of a composition or article can be of any type. The amorphous alloy can comprise the element Zr, Hf, Ti, Cu, Ni, Pt, Pd, Fe, Mg, Au, La, Ag, Al, Mo, Nb, Be, or combinations thereof. Namely, the alloy can include any combination of these elements in its chemical formula or chemical composition. The elements can be present at different weight or volume percentages. For example, an iron "based" alloy can refer to an alloy having a non-insignificant weight percentage of iron present therein, the weight percent can be, for example, at least about 20 wt %, such as at least about 40 wt %, such as at least about 50 wt %, such as at least about 60 wt %, such as at least about 80 wt %. Alternatively, in one embodiment, the above-described percentages can be volume percentages, instead of weight percentages. Accordingly, an amorphous alloy can be zirconium-based, titanium-based, platinum-based, palladium-based, gold-based, silver-based, copper-based, iron-based, nickel-based, aluminum-based, molybdenum-based, and the like. The alloy can also be free of any of the aforementioned elements to suit a particular purpose. For example, in some embodiments, the alloy, or the composition including the alloy, can be substantially free of nickel, aluminum, titanium, beryllium, or combinations thereof. In one embodiment, the alloy or the composite is completely free of nickel, aluminum, titanium, beryllium, or combinations thereof.

For example, the amorphous alloy can have the formula $(Zr, Ti)_a(Ni, Cu, Fe)_b(Be, Al, Si, B)_c$, wherein a, b, and c each represents a weight or atomic percentage. In one embodiment, a is in the range of from 30 to 75, b is in the range of from 5 to 60, and c is in the range of from 0 to 50 in atomic percentages. Alternatively, the amorphous alloy can have the formula $(Zr, Ti)_a(Ni, Cu)_b(Be)_c$, wherein a, b, and c each represents a weight or atomic percentage. In one embodiment, a is in the range of from 40 to 75, b is in the range of from 5 to 50, and c is in the range of from 5 to 50 in atomic percentages. The alloy can also have the formula $(Zr, Ti)_a(Ni, Cu)_b(Be)_c$, wherein a, b, and c each represents a weight or atomic percentage. In one embodiment, a is in the range of from 45 to 65, b is in the range of from 7.5 to 35, and c is in the range of from 10 to 37.5 in atomic percentages. Alternatively, the alloy can have the formula $(Zr)_a(Nb, Ti)_b(Ni, Cu)_c(Al)_d$, wherein a, b, c, and d each represents a weight or atomic percentage. In one embodiment, a is in the range of from 45 to 65, b is in the range of from 0 to 10, c is in the range of from 20 to 40 and d is in the range of from 7.5 to 15 in atomic percentages. One exemplary embodiment of the aforedescribed alloy system is a Zr—Ti—Ni—Cu—Be based amorphous alloy under the trade name Vitreloy™ such as Vitreloy-1 and Vitreloy-101, as fabricated by Liquidmetal Technologies, CA, USA. Some examples of amorphous alloys of the different systems are provided in Table 1 and Table 2.

TABLE 1

Exemplary amorphous alloy compositions

| Alloy | Atm % | Atm % | Atm % | Atm % | Atm % | Atm % | Atm % | Atm % |
|---|---|---|---|---|---|---|---|---|
| 1 | Fe | Mo | Ni | Cr | P | C | B | |
| | 68.00% | 5.00% | 5.00% | 2.00% | 12.50% | 5.00% | 2.50% | |
| 2 | Fe | Mo | Ni | Cr | P | C | B | Si |
| | 68.00% | 5.00% | 5.00% | 2.00% | 11.00% | 5.00% | 2.50% | 1.50% |
| 3 | Pd | Cu | Co | P | | | | |
| | 44.48% | 32.35% | 4.05% | 19.11% | | | | |
| 4 | Pd | Ag | Si | P | | | | |
| | 77.50% | 6.00% | 9.00% | 7.50% | | | | |
| 5 | Pd | Ag | Si | P | Ge | | | |
| | 79.00% | 3.50% | 9.50% | 6.00% | 2.00% | | | |
| 6 | Pt | Cu | Ag | P | B | Si | | |
| | 74.70% | 1.50% | 0.30% | 18.0% | 4.00% | 1.50% | | |

TABLE 2

Additional Exemplary amorphous alloy compositions (atomic %)

| Alloy | Atm % | Atm % | Atm % | Atm % | Atm % | Atm % |
|---|---|---|---|---|---|---|
| 1 | Zr | Ti | Cu | Ni | Be | |
| | 41.20% | 13.80% | 12.50% | 10.00% | 22.50% | |
| 2 | Zr | Ti | Cu | Ni | Be | |
| | 44.00% | 11.00% | 10.00% | 10.00% | 25.00% | |
| 3 | Zr | Ti | Cu | Ni | Nb | Be |
| | 56.25% | 11.25% | 6.88% | 5.63% | 7.50% | 12.50% |
| 4 | Zr | Ti | Cu | Ni | Al | Be |
| | 64.75% | 5.60% | 14.90% | 11.15% | 2.60% | 1.00% |
| 5 | Zr | Ti | Cu | Ni | Al | |
| | 52.50% | 5.00% | 17.90% | 14.60% | 10.00% | |
| 6 | Zr | Nb | Cu | Ni | Al | |
| | 57.00% | 5.00% | 15.40% | 12.60% | 10.00% | |
| 7 | Zr | Cu | Ni | Al | | |
| | 50.75% | 36.23% | 4.03% | 9.00% | | |
| 8 | Zr | Ti | Cu | Ni | Be | |
| | 46.75% | 8.25% | 7.50% | 10.00% | 27.50% | |
| 9 | Zr | Ti | Ni | Be | | |
| | 21.67% | 43.33% | 7.50% | 27.50% | | |
| 10 | Zr | Ti | Cu | Be | | |
| | 35.00% | 30.00% | 7.50% | 27.50% | | |
| 11 | Zr | Ti | Co | Be | | |
| | 35.00% | 30.00% | 6.00% | 29.00% | | |
| 12 | Zr | Ti | Fe | Be | | |
| | 35.00% | 30.00% | 2.00% | 33.00% | | |
| 13 | Au | Ag | Pd | Cu | Si | |
| | 49.00% | 5.50% | 2.30% | 26.90% | 16.30% | |
| 14 | Au | Ag | Pd | Cu | Si | |
| | 50.90% | 3.00% | 2.30% | 27.80% | 16.00% | |
| 15 | Pt | Cu | Ni | P | | |
| | 57.50% | 14.70% | 5.30% | 22.50% | | |
| 16 | Zr | Ti | Nb | Cu | Be | |
| | 36.60% | 31.40% | 7.00% | 5.90% | 19.10% | |
| 17 | Zr | Ti | Nb | Cu | Be | |
| | 38.30% | 32.90% | 7.30% | 6.20% | 15.30% | |
| 18 | Zr | Ti | Nb | Cu | Be | |
| | 39.60% | 33.90% | 7.60% | 6.40% | 12.50% | |
| 19 | Cu | Ti | Zr | Ni | | |
| | 47.00% | 34.00% | 11.00% | 8.00% | | |
| 20 | Zr | Co | Al | | | |
| | 55.00% | 25.00% | 20.00% | | | |

Other exemplary ferrous metal-based alloys include compositions such as those disclosed in U.S. Patent Application Publication Nos. 2007/0079907 and 2008/0118387. These compositions include the Fe(Mn, Co, Ni, Cu) (C, Si, B, P, Al) system, wherein the Fe content is from 60 to 75 atomic percentage, the total of (Mn, Co, Ni, Cu) is in the range of from 5 to 25 atomic percentage, and the total of (C, Si, B, P, Al) is in the range of from 8 to 20 atomic percentage, as well as the exemplary composition Fe48Cr15Mo14Y2C15B6. They also include the alloy systems described by Fe—Cr—Mo—(Y,Ln)-C—B, Co—Cr—Mo-Ln-C—B, Fe—Mn—Cr—Mo—(Y,Ln)-C—B, (Fe, Cr, Co)—(Mo,Mn)—(C,B)—Y, Fe—(Co,Ni)—(Zr,Nb,Ta)—(Mo,W)—B, Fe—(Al,Ga)—(P,C,B,Si,Ge), Fe—(Co, Cr,Mo,Ga,Sb)—P—B—C, (Fe, Co)—B—Si—Nb alloys, and Fe—(Cr—Mo)—(C,B)—Tm, where Ln denotes a lanthanide element and Tm denotes a transition metal element. Furthermore, the amorphous alloy can also be one of the exemplary compositions Fe80P12.5C5B2.5, Fe80P11C5B2.5Si1.5, Fe74.5Mo5.5P12.5C5B2.5, Fe74.5Mo5.5P11C5B2.5Si1.5, Fe70Mo5Ni5P12.5C5B2.5, Fe70Mo5Ni5P11C5B2.5Si1.5, Fe68Mo5Ni5Cr2P12.5C5B2.5, and Fe68Mo5Ni5Cr2P11C5B2.5Si1.5, described in U.S. Patent Application Publication No. 2010/0300148.

The amorphous alloys can also be ferrous alloys, such as (Fe, Ni, Co) based alloys. Examples of such compositions are disclosed in U.S. Pat. Nos. 6,325,868; 5,288,344; 5,368,659; 5,618,359; and 5,735,975, Inoue et al., Appl. Phys. Lett., Volume 71, p 464 (1997), Shen et al., Mater. Trans., JIM, Volume 42, p 2136 (2001), and Japanese Patent Application No. 200126277 (Pub. No. 2001303218 A). One exemplary composition is $Fe_{72}Al_5Ga_2P_{11}C_6B_4$. Another example is $Fe_{72}Al_7Zr_{10}Mo_5W_2B_{15}$. Another iron-based alloy system that can be used in the coating herein is disclosed in U.S. Patent Application Publication No. 2010/0084052, wherein the amorphous metal contains, for example, manganese (1 to 3 atomic %), yttrium (0.1 to 10 atomic %), and silicon (0.3 to 3.1 atomic %) in the range of composition given in parentheses; and that contains the following elements in the specified range of composition given in parentheses: chromium (15 to 20 atomic %), molybdenum (2 to 15 atomic %), tungsten (1 to 3 atomic %), boron (5 to 16 atomic %), carbon (3 to 16 atomic %), and the balance iron.

The aforedescribed amorphous alloy systems can further include additional elements, such as additional transition metal elements, including Nb, Cr, V, and Co. The additional elements can be present at less than or equal to about 30 wt %, such as less than or equal to about 20 wt %, such as less than or equal to about 10 wt %, such as less than or equal to about 5 wt %. In one embodiment, the additional, optional element is at least one of cobalt, manganese, zirconium, tantalum, niobium, tungsten, yttrium, titanium, vanadium and hafnium to form carbides and further improve wear and corrosion resistance. Further optional elements may include phosphorous, germanium and arsenic, totaling up to about 2%, and preferably less than 1%, to reduce melting point. Otherwise incidental impurities should be less than about 2% and preferably 0.5%.

In some embodiments, a composition having an amorphous alloy can include a small amount of impurities. The impurity elements can be intentionally added to modify the properties of the composition, such as improving the mechanical properties (e.g., hardness, strength, fracture mechanism, etc.) and/or improving the corrosion resistance. Alternatively, the impurities can be present as inevitable, incidental impurities, such as those obtained as a byproduct of processing and manufacturing. The impurities can be less than or equal to about 10 wt %, such as about 5 wt %, such as about 2 wt %, such as about 1 wt %, such as about 0.5 wt %, such as about 0.1 wt %. In some embodiments, these percentages can be volume percentages instead of weight percentages. In one embodiment, the alloy sample/composition consists essentially of the amorphous alloy (with only a small incidental amount of impurities). In another embodiment, the composition includes the amorphous alloy (with no observable trace of impurities).

In one embodiment, the final parts exceeded the critical casting thickness of the bulk solidifying amorphous alloys.

In embodiments herein, the existence of a supercooled liquid region in which the bulk-solidifying amorphous alloy can exist as a high viscous liquid allows for superplastic forming. Large plastic deformations can be obtained. The ability to undergo large plastic deformation in the supercooled liquid region is used for the forming and/or cutting process. As oppose to solids, the liquid bulk solidifying alloy deforms locally which drastically lowers the required energy for cutting and forming. The ease of cutting and forming depends on the temperature of the alloy, the mold, and the cutting tool. As higher is the temperature, the lower is the viscosity, and consequently easier is the cutting and forming.

Embodiments herein can utilize a thermoplastic-forming process with amorphous alloys carried out between Tg and Tx, for example. Herein, Tx and Tg are determined from standard DSC measurements at typical heating rates (e.g. 20° C./min) as the onset of crystallization temperature and the onset of glass transition temperature.

The amorphous alloy components can have the critical casting thickness and the final part can have thickness that is thicker than the critical casting thickness. Moreover, the time and temperature of the heating and shaping operation is selected such that the elastic strain limit of the amorphous alloy could be substantially preserved to be not less than 1.0%, and preferably not being less than 1.5%. In the context of the embodiments herein, temperatures around glass transition means the forming temperatures can be below glass transition, at or around glass transition, and above glass transition temperature, but preferably at temperatures below the crystallization temperature $T_X$. The cooling step is carried out at rates similar to the heating rates at the heating step, and preferably at rates greater than the heating rates at the heating step. The cooling step is also achieved preferably while the forming and shaping loads are still maintained.

Electronic Devices

The embodiments herein can be valuable in the fabrication of electronic devices using a BMG. An electronic device herein can refer to any electronic device known in the art. For example, it can be a telephone, such as a cell phone, and a land-line phone, or any communication device, such as a smart phone, including, for example an iPhone™, and an electronic email sending/receiving device. It can be a part of a display, such as a digital display, a TV monitor, an electronic-book reader, a portable web-browser (e.g., iPad™), and a computer monitor. It can also be an entertainment device, including a portable DVD player, conventional DVD player, Blue-Ray disk player, video game console, music player, such as a portable music player (e.g., iPod™), etc. It can also be a part of a device that provides control, such as controlling the streaming of images, videos, sounds (e.g., Apple TV™), or it can be a remote control for an electronic device. It can be a part of a computer or its accessories, such as the hard drive tower housing or casing, laptop housing, laptop keyboard, laptop track pad, desktop keyboard, mouse, and speaker. The article can also be applied to a device such as a watch or a clock.

Fasteners

A fastener is a hardware device that mechanically joins or affixes two or more objects together. Fasteners can also be used to close a container such as a bag, a box, an enclosure or an envelope; or they may involve keeping together the sides of an opening of flexible material, attaching a lid to a container or a laptop, etc. Fasteners can be temporary, in that they may be fastened and unfastened repeatedly, or permanent, in that they cannot be removed without destroying the fasteners. The fasteners of the embodiments herein are limited to permanent fasteners.

Items like a rope, string, wire (e.g. metal wire, possibly coated with plastic, or multiple parallel wires kept together by a plastic strip coating), cable, chain, or plastic wrap may be used to mechanically join objects; but are not categorized as fasteners according to the embodiments herein because they have additional common uses. Likewise, hinges and springs may join objects together, but are not considered fasteners because their primary purpose is to allow articulation rather than rigid affixment. Other alternative methods of joining materials include crimping, welding, soldering, brazing, taping, gluing, cementing, or the use of other adhesives, but are also not considered fastening according to the fasteners of the embodiments herein. The use of force may also be used for fastening, such as with magnets, vacuum (like suction cups), or even friction, but are not considered fastening according to the fasteners of the embodiments herein.

An embodiment herein relates to a high strength permanent or semi-permanent bonding method using a fine array of amorphous alloy hooks on a surface. The hooked surface could either be pressed into a surface with loops or similar hooks so that that the hooks catch on one another. In a permanent bond, the hooks would be designed so that they would have to be broken, melted, or cut, in order to separate the two pieces of material. In a semi-permanent bond, the hooks would be designed so that a certain amount of force would deform the hooks plastically, enough so that the two materials could be separated. The fasteners of the embodiments include a zipper. Zippers include airtight and watertight zippers that could be used sealing electronic devices, for example, the enclosure of a cell phone.

The embodiments herein relate to fasteners comprising bulk solidifying amorphous alloy for applications that would utilize the unique features of bulk solidifying amorphous metal alloys, namely high elasticity such that the elastic strain limit could be 1.5% or greater (versus about 0.5% of crystalline metal alloys), and the thermoplastic forming capability of bulk solidifying amorphous metal alloys. According to the embodiments herein, one could extrude small wires of bulk solidifying amorphous alloys through a substrate of some sort, wherein these small wires would be similar in shape and structures as the hook and/or loop that one uses for typical Velcro fasteners and could make the world's strongest Velcro type fastener.

If one made these hook and/or loop of bulk solidifying amorphous metal alloy one would get a much greater holding strength to the material than a conventional Velcro fastener made of plastic. One could separate the Velcro type fastener by heating the hook and/or look above the Tg of the bulk solidifying amorphous metal alloy, and applying some force to separate the hook and loop portions of the Velcro type fastener. The above type of the Velcro fastener would be a semi-permanent Velcro type fastener.

Also, one could make a permanent Velcro type fastener. In this case, one could deactivate the Velcro type fastener of the embodiments herein, essentially, by reheating those hooks and loops to crystallize them which would make them very brittle and susceptible to breakage. This would make the Velcro type fastener a permanent fastener that can only be separated by breaking hooks and/or loops of the Velcro type fastener.

Manufacture of the Fasteners

The Velcro type fasteners of the embodiments have two components: a hook side fastener having hooks and a loop side fastener having loops. The hook side fastener and the loop side fastener are bonded together to form permanent or semi-permanent bonding.

There are several ways to manufacture the fasteners of the embodiments herein depending on the type of the fastener. If one were to form the hooks and then use them as Velcro, then would form the hook at around Tg and use them at temperature below Tg. After forming the hooks, one could use them as Velcro, but one could also partially crystallize the hooks to make a security hook that would break if someone would attempt to peel open the hook. If one were to form a "security hook", then one could form permanent hooks at around Tg (on a final part) and adhere two surfaces together such that the two surfaces could never be removed without destroying the hooks. If someone would separate the two surfaces, they will not be able to put them back to adhere the two surfaces.

One method for making the hook side fastener is described below in conjunction with FIGS. 3A and 3B. FIG. 3A shows a top hot plate with an arrow, meaning that the hot plate is moving in a downward direction towards the BMG preform below that is placed on a forming device having holes therein (also referred to as the forming plate) and that is fixed to some type of a fixture to hold it in place on a bottom hot plate. The BMG preform could be just like a block of material or a sheet or in some other form depending on what one is trying to make. It depends on the size of the fastener. However, in one embodiment, the BMG preform could be a thin sheet of BMG material. The BMG preform could be placed on the bottom hot plate by a human or a machine. The area of the BMG preform could be small or large, even though FIG. 3A shows a hot plate press with top and bottom plates. FIG. 3B shows the top hot press pushing on to the hot BMG perform, wherein the hot BMG preform is heated above Tg, for example to a molten state above Tm or to a softened state between Tg and Tm, preferably between Tg and Tx, so as to cause some hot BMG preform to flow through the holes in the forming device. The strands of the BMG material coming out of the holes in the forming device in FIG. 3B are cooled, and curved to form a hook. For example, the strands can curved to form hooks by blowing gas or liquid from one direction to another past the hanging strands, and simultaneously cooling the hanging strands as shown in FIG. 3B.

Figure 4:
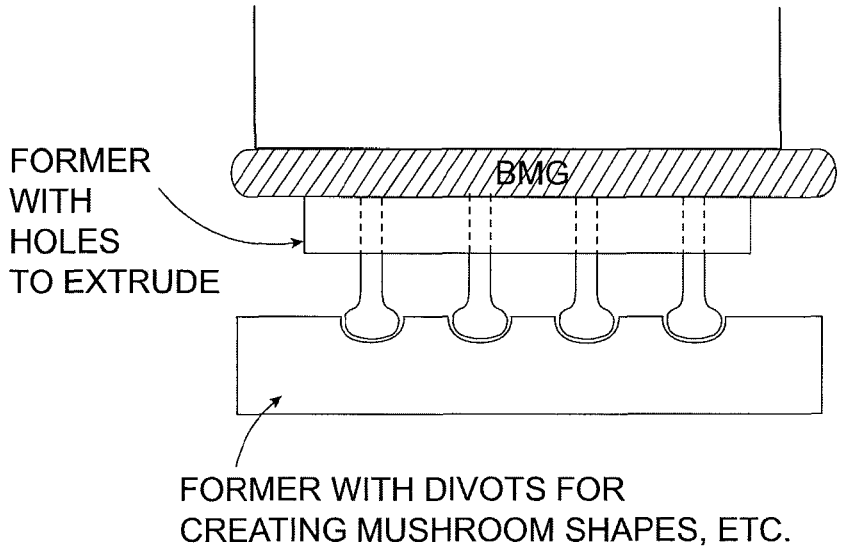
FIG. 4 provides a schematic of a method to manufacture a hook side fastener of the embodiments herein, wherein the hooks are bulb or mushroom shaped.

In another embodiment, the bottom ends of the hanging strands can shaped to have the shape of a bulb or mushroom as shown in FIG. 4. In FIG. 4, the hot plate is in contact with the preform and the BMG flows through the holes or openings that are in the forming plate to form strands. The bottom ends of the hanging strands are rounded to form a bulbous shape at the bottom ends of the hanging strands.

Generally, all of the BMG material in the preform is not pushed out through the holes in the forming device. Instead, one would have a BMG skin remaining on the other side of the forming device, i.e., the top side of the forming device in FIGS. 3B and 4 such that the portion of the BMG preform remaining above the forming device would become a substrate of the hook side fastener.

One could remove the forming plate from the hook side fastener or leave the forming plate as an integral part of the hook side fastener. The forming plate could be removed by etching, for example, by selecting a forming plate material that readily dissolves away leaving just amorphous alloy in the final hook side fastener structure. Alternatively, for example, one could use a metal foil or something with holes in it (e.g., a sheet steel with perforated laser-drilled holes) and leave it remain bonded to the final structure of the hook side fastener.

The forming plate could be made of any suitable conductor of heat. One could use a tool steel with heating cartridges. One can use circulated oil to heat it. One could have the forming plate inductively heated to generate the necessary temperatures. One might even use something that would heat the forming plate even before the top hot plate contacts the amorphous alloy. One could heat the amorphous alloy inductively or with radiant heat or using a resistance heating system to soften it and then apply pressure by the hot plates subsequently or simultaneously.

The BMG preform would be heated to some temperature above the glass transition temperature of the BMG preform, and a pressure would be applied to form the hook side fastener structure. The temperature of the BMG preform could be decoupled from the pressure applied, or both could be simultaneous. For example, in one embodiment one could use a zirconium-based alloy with a forming temperature around 450° C. and could use a piece of sheet stock aluminum, 5061 aluminum, with a very thin thickness, 10 gauge, for the forming plate. One could laser drill a sequence of holes in the forming plate. One could put an amorphous alloy feedstock on top of the forming plate as shown in FIG. 3A. Then, one could heat the amorphous alloy and press it through the aluminum forming plate. At that point, one could leave the aluminum forming plate there, and one would have the hooks protruding from one side of the forming plate and an amorphous alloy sandwich on the other side of the forming plate. In this case, as the forming plate would not have been dissolved away, it would just become integral to the whole hook side fastener structure. Alternatively, one could take an acid that readily etches aluminum but not amorphous alloy and dissolve away the forming plate, leaving only an amorphous hook side fastener structure.

FIGS. 5A to 5E are schematics showing an embodiment of producing a loop side fastener having loops made of BMG alloy. According to the method shown in FIGS. 5A to 5E, one could make Velcro-type fasteners where the loop side fastener having loops is made of BMG alloy so that both the hoop side fastener and the loop side fastener have the same or substantially the same strength. If one would just use a hook side fastener with hooks made of one material and a loop side fastener with loops of another material and the hook side fastener and the loop side fastener are attached, then the bond would only be as strong the weaker of the hook side fastener or the loop side fastener. However, by using a loop side fastener made according to the method of FIGS. 5A to 5E and a hook side fastener made according to the method of FIGS. 3A and 3B, wherein both the loop side fastener and the hook side fastener are made of the same or substantially the same BMG alloy, one can make Velcro-type fasteners where both the hook side fastener and the loop side fastener have the same or substantially the same strength.

The method shown in FIGS. 5A to 5E could be as follows. One could have a pool of molten or softened BMG as shown in FIG. 5A. Softened BMG means BMG in the hot forming regime between Tg and Tm of the metal alloy of the BMG. The molten or softened BMG can adhere to a pin made of certain materials. So one could got a whole array of pins, which could be a two-dimensional array of pins, that one could dip into the molten or softened BMG as shown in FIG. 5B. The molten or softened BMG would adhere to the pins and drawn up like a strand as shown in FIG. 5C. The drawn up BMG strand could then be bent around in an arc shape and made to touch the pool of molten or softened BMG to form a loop as shown in FIG. 5D. By repeating the above loop forming steps, one could form these little loops of BMG by getting the tips of that BMG strands to bend into the bulk BMG again as shown in FIG. 5E, thereby creating an array of loops that would then form the loop side fastener having loops made of BMG. While FIGS. 5A to 5E show the pool of molten or softened BMG to be substantially thicker than the height of the loop, in reality the thickness of the molten or softened BMG pool could be thicker, of similar thickness or thinner than the height of the loops formed on the molten or softened BMG pool. After cooling the molten or softened BMG pool with the loops thereon, one would form the loop side fastener made of BMG with the solidified BMG pool being the substrate of the loop side BMG fastener.

Examples of Permanent and Semi-Permanent Fastening

Once one has formed the hooks or fasteners, using the method discussed above, one would be able to use them or place them next to or adjacent another set of hooks, loops or some type of catch or a substrate that has a catching device that could be similar or different, it does not matter, and then form either a semi-permanent or permanent bonding by pressing the two or more fasteners or hooks together. In this way, the fasteners will hook or catch on one another, and as one way to separate these attached fasteners would be by some process that would actually break the bond. Alternatively, if the amorphous alloy has sufficient elasticity, one could mechanically separate the attached fasteners just by pulling them apart without damaging the structure, particularly by heating the fasteners to a temperature above the glass transition temperature. If it turns out that the hooks, when they are joined to the other side, have insufficient strength that it would be difficult to remove them without damaging them, then one would have to actually break that attached fastener structure to separate the fasteners.

Figure 6A:
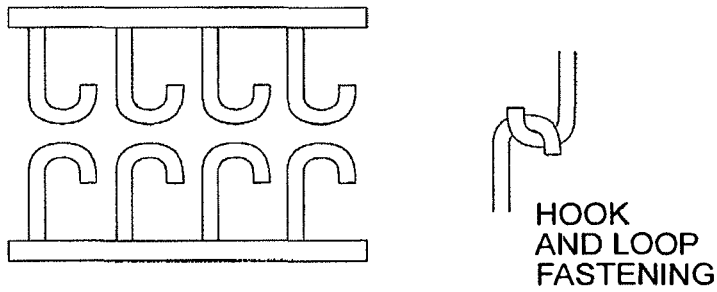
FIGS. 6A to 6C provide schematic diagrams of some fasteners and fastening according to embodiments herein.
Figure 6B:
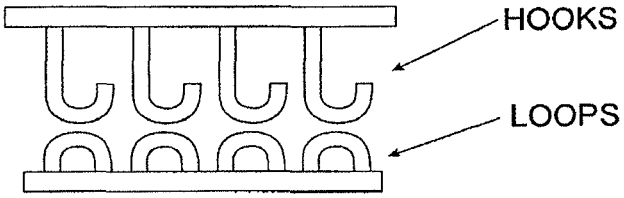
Figure 6C:
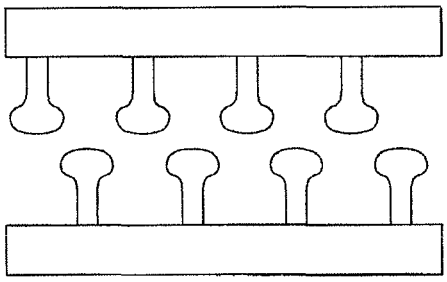

Furthermore, one could form permanent or semi-permanent fasteners by crystallizing the BMG hooks of the fastener after attachment of the BMG fastener to another fastener or hooks/loops on another substrate. In short, one could design these hooks of the BMG fastener so that they could be released without breaking them, or we could design them in such a way that they require permanent deformation and breaking in order for the fastener to be separated. Schematic diagrams of some fasteners and fastening according to embodiments herein are shown in FIGS. 6A to 6C.

Uses of Permanent and Semi-Permanent Fasteners

Unlike soldering which is kind of a melt process, the permanent or semi-permanent amorphous alloy fastening using the embodiments of the fasteners herein could be at a room temperature or a thermoplastic-forming temperature of the amorphous alloy. Furthermore, thermoplastic-forming of amorphous alloys could be done without excessive heating, for example, at temperatures in the range of 300-500 degree C.—typically in the range of 400-500 degree C. for Zr-based alloys and substantially lower for precious metal-based amorphous alloys. Also, amorphous alloys soften and can undergo strains of hundreds of percent, limited only by the applied strain rate. In addition, amorphous alloys will exhibit their full strength and hardness immediately after the thermoplastic-forming process, and typical values are comparable to high strength steels or titanium alloys. Thus, this fastening process using the fasteners of the embodiments herein is capable of generating high localized strains at relatively low temperatures while producing an extremely high strength junction between the fastener and the substrate into which the fastener is fastened. Furthermore, in the case of permanent fasteners, this junction will be difficult to separate without causing substantial damage to the joined parts, i.e., the fastener and substrate.

Also, one could locally heat the hook or loop very precisely, for example by induction heating or laser heating prior to the thermoplastic forming process of the hook or loop. One could join an amorphous alloy to dissimilar materials. One could reheat the amorphous alloy in the vicinity of the junction to render it crystalline and brittle.

Tamper-resistant permanent amorphous alloy fastening could be used for tamper-resistant electronic devices such as a computer and cell phone, for example. Tamper-resistant amorphous alloy fastening could be used for set-top boxes and other devices that use digital rights management.

Tamper-resistant amorphous alloy fastening for nuclear reactors that are intended to be sold to countries that otherwise do not possess nuclear weapons need to be made tamper-resistant to prevent nuclear proliferation. For example, the tamper-resistance amorphous alloy fastening technique could be combined with detection and alarms in place that sound if attempts at entry are detected.

What is claimed:

1. A method comprising:

attaching a first portion of a hook-and-loop fastener comprising a first set of lineally arranged hooks extending from and integrally formed with a base to a second portion of a hook-and-loop fastener comprising one or both of a second set of lineally arranged hooks or a set of lineally arranged loops extending from and integrally formed with a base to form an at least semi-permanent bond between the first portion of the hook-and-loop fastener and the second portion of the hook-and-loop fastener, wherein the base and at least one of the first portion or the second portion of the hook-and-loop fastener comprises a bulk solidifying amorphous alloy.

2. The method of claim 1, wherein the attaching is performed at a temperature below or greater than a glass transition temperature (Tg) of the bulk solidifying amorphous alloy.

3. The method of claim 1, wherein:

the second portion of the hook-and-loop fastener comprises the second set of lineally arranged hooks; and the first and second portions of the hook-and-loop fastener comprise the bulk solidifying amorphous alloy.

4. The method of claim 1, wherein during the attaching, a localized temperature of at least one of the group consisting of the first set of lineally arranged hooks, the second set of lineally arranged hooks, and the set of lineally arranged loops is above a glass transition temperature (Tg) of the bulk solidifying amorphous alloy.

5. The method of claim 1, further comprising at least partially crystallizing at least a portion of at least one of the group consisting of the first set of lineally arranged hooks, the second set of lineally arranged hooks, and the set of lineally arranged loops.

6. A method of manufacturing a hook-and-loop fastener, comprising forming, from a bulk solidifying amorphous alloy, a plurality of lineally arranged hooks extending from and integrally formed with a base comprising the bulk solidifying amorphous alloy.

7. The method of claim 6, wherein forming the lineally arranged plurality of hooks comprises:

heating the bulk solidifying amorphous alloy above a glass transition temperature (Tg) of the bulk solidifying amorphous alloy; and while the bulk solidifying amorphous alloy is above the Tg, placing the bulk solidifying amorphous alloy and a forming device in contact with one another to form the hooks.

8. The method of claim 7, wherein the forming device comprises a plate defining a plurality of holes extending through the plate.

9. The method of claim 6, wherein forming the lineally arranged plurality of hooks comprises:

heating the bulk solidifying amorphous alloy to a temperature between a glass transition temperature (Tg) and a melting temperature (Tm) of the bulk solidifying amorphous alloy; and while the bulk solidifying amorphous alloy is between the Tg and the Tm, placing the bulk solidifying amorphous alloy and a forming device in contact with one another to form the hooks.

10. The method of claim 6, wherein forming the lineally arranged plurality of hooks comprises:

heating the bulk solidifying amorphous alloy to a melting point of the bulk solidifying amorphous alloy (Tm) or above;

inserting the bulk solidifying amorphous alloy into a forming device; and cooling the bulk solidifying amorphous alloy to a temperature below a glass transition temperature (Tg) of the bulk solidifying amorphous alloy to form the hooks.

11. A method of manufacturing a hook-and-loop fastener, comprising:

forming, from a bulk solidifying amorphous alloy, a plurality of lineally arranged loops extending from and integrally formed with a base comprising the bulk solidifying amorphous alloy.

12. The method of claim 11, wherein forming the lineally arranged plurality of loops comprises:

heating the bulk solidifying amorphous alloy above a glass transition temperature (Tg) of the bulk solidifying amorphous alloy; and while the bulk solidifying amorphous alloy is above the Tg:

forming strands of the bulk solidifying amorphous alloy; and bending the strands to form loops.

13. The method of claim 12, wherein the operation of forming the strands comprises:

inserting an array of pins into the bulk solidifying amorphous alloy; and drawing the pins away from the base to form the strands.

14. The method of claim 11, wherein forming the lineally arranged plurality of loops comprises:

heating the bulk solidifying amorphous alloy to a temperature between a glass transition temperature (Tg) and a melting temperature (Tm) of the bulk solidifying amorphous alloy; and while the bulk solidifying amorphous alloy is between the Tg and the Tm:

forming strands of the bulk solidifying amorphous alloy; and bending the strands to form the loops.

15. The method of claim 11, wherein forming the lineally arranged plurality of loops comprises:

heating the bulk solidifying amorphous alloy to a melting point of the metal alloy (Tm) or above;

forming strands of the bulk solidifying amorphous alloy;

bending the strands; and cooling the bulk solidifying amorphous alloy to a temperature below a glass transition temperature (Tg) of the bulk solidifying amorphous alloy to form the loops.

16. A fastener comprising:

a base portion comprising a bulk solidifying amorphous alloy; and a plurality of lineally arranged hooks comprising the bulk solidifying amorphous alloy and integrally formed with and extending from the base to form a portion of a hook-and-loop fastener.

17. The fastener of claim 16, wherein the bulk solidifying amorphous alloy is described by the following molecular formula: $(Zr, Ti)_a(Ni, Cu, Fe)_b(Be, Al, Si, B)_c$, wherein "a" is in the range of from 30 to 75, "b" is in the range of from 5 to 60, and "c" is in the range of from 0 to 50 in atomic percentages.

18. The fastener of claim 16, wherein the bulk solidifying amorphous alloy is described by the following molecular formula: $(Zr, Ti)_a(Ni, Cu)_b(Be)_c$, wherein "a" is in the range of from 40 to 75, "b" is in the range of from 5 to 50, and "c" is in the range of from 5 to 50 in atomic percentages.

19. A fastener comprising:

a base portion comprising a bulk solidifying amorphous alloy; and a plurality of lineally arranged loops comprising the bulk solidifying amorphous alloy and integrally formed with and extending from the base portion to form a portion of a hook-and-loop fastener.

20. The fastener of claim 19, wherein the bulk solidifying amorphous alloy is described by the following molecular formula: $(Zr, Ti)_a(Ni, Cu, Fe)_b(Be, Al, Si, B)_c$, wherein "a" is in the range of from 30 to 75, "b" is in the range of from 5 to 60, and "c" is in the range of from 0 to 50 in atomic percentages.

21. The fastener of claim 19, wherein the bulk solidifying amorphous alloy is described by the following molecular formula: $(Zr, Ti)_a(Ni, Cu)_b(Be)_c$, wherein "a" is in the range of from 40 to 75, "b" is in the range of from 5 to 50, and "c" is in the range of from 5 to 50 in atomic percentages.

* * * * *